US008758162B2

(12) United States Patent
Ban

(10) Patent No.: US 8,758,162 B2
(45) Date of Patent: Jun. 24, 2014

(54) GOLF CLUB HEAD

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 511 days.

(21) Appl. No.: 13/050,469

(22) Filed: Mar. 17, 2011

(65) Prior Publication Data

US 2011/0269568 A1 Nov. 3, 2011

(30) Foreign Application Priority Data

Apr. 30, 2010 (JP) ..... 2010-105954

(51) Int. Cl.
*A63B 53/04* (2006.01)

(52) U.S. Cl.
USPC ..... 473/331

(58) Field of Classification Search
USPC ..... 473/324–350
See application file for complete search history.

(56) References Cited

U.S. PATENT DOCUMENTS

| | | | | |
|---|---|---|---|---|
| 1,965,954 | A | 7/1934 | Davis | |
| 3,869,126 | A | 3/1975 | Thompson | |
| 5,029,864 | A | 7/1991 | Keener | |
| 5,437,088 | A * | 8/1995 | Igarashi | 29/527.6 |
| 5,618,239 | A | 4/1997 | Rife | |
| 5,688,190 | A | 11/1997 | Rowland et al. | |
| 5,690,561 | A | 11/1997 | Rowland et al. | |
| 5,709,616 | A | 1/1998 | Rife | |
| 5,792,004 | A | 8/1998 | Nagamoto | |
| 6,224,497 | B1 * | 5/2001 | Antonious | 473/330 |
| 7,594,863 | B2 * | 9/2009 | Ban | 473/331 |
| 7,674,188 | B2 * | 3/2010 | Ban | 473/330 |
| 7,677,990 | B2 * | 3/2010 | Ban | 473/331 |
| 7,695,377 | B2 * | 4/2010 | Yamagishi et al. | 473/331 |
| 7,819,756 | B2 | 10/2010 | Ban et al. | |
| 7,901,297 | B2 * | 3/2011 | Ban et al. | 473/331 |
| 7,918,747 | B2 * | 4/2011 | Johnson et al. | 473/328 |

(Continued)

FOREIGN PATENT DOCUMENTS

| | | | |
|---|---|---|---|
| JP | 07-313639 | A | 5/1995 |
| JP | 8-000777 | A | 1/1996 |

(Continued)

OTHER PUBLICATIONS

Japanese Office Action, dated Nov. 29, 2013, issued in corresponding Japanese Patent Application No. 2010-105954.

*Primary Examiner* — Alvin Hunter
(74) *Attorney, Agent, or Firm* — Sughrue Mion, PLLC

(57) ABSTRACT

This invention provides a golf club head in which a plurality of scorelines are formed in its face surface at an equal pitch. Rounded portions are formed on the edges of the scorelines. Each region between adjacent scorelines includes a fine groove formation region in which N (N≥2) fine grooves are formed to extend parallel to the scorelines and to align themselves in a direction perpendicular to the scorelines at an interval d (d≥0). Letting S be the distance between the endpoints of the rounded portions of the adjacent scorelines, Wt be the sum total of the widths of all the fine grooves, A1 be the distance from the endpoint of the rounded portion of one scoreline of the adjacent scorelines to the fine groove formation region, A2 be the distance from the endpoint of the rounded portion of the other scoreline of the adjacent scorelines to the fine groove formation region, and Wmax be the maximum width of the widths of the fine grooves, $0 \le A1+A2 < Wmax+d$, $|A1-A2| < (Wmax+d)/4$, and $Wt+d\times(N-1)+A1+A2=S$.

14 Claims, 11 Drawing Sheets

(56) References Cited

U.S. PATENT DOCUMENTS

| | | | | |
|---|---|---|---|---|
| 8,012,036 | B2 * | 9/2011 | Nakamura | 473/290 |
| 8,118,688 | B2 * | 2/2012 | Nakamura | 473/331 |
| 8,491,415 | B2 | 7/2013 | Ishikawa et al. | |
| 8,506,420 | B2 * | 8/2013 | Hocknell et al. | 473/331 |
| 2005/0245329 | A1 | 11/2005 | Nishitani et al. | |
| 2005/0250594 | A1 | 11/2005 | Nishitani et al. | |
| 2008/0020859 | A1 | 1/2008 | Yamagishi et al. | |
| 2008/0125241 | A1 | 5/2008 | Tateno et al. | |
| 2008/0125242 | A1 | 5/2008 | Ban | |
| 2008/0125243 | A1 | 5/2008 | Ban | |
| 2008/0132351 | A1 | 6/2008 | Ban et al. | |
| 2008/0132352 | A1 | 6/2008 | Ban | |
| 2009/0176597 | A1 | 7/2009 | Yamagishi et al. | |
| 2009/0247318 | A1 | 10/2009 | Ban et al. | |
| 2010/0087270 | A1 | 4/2010 | Ban et al. | |

FOREIGN PATENT DOCUMENTS

| | | | | | |
|---|---|---|---|---|---|
| JP | 8-196666 | A | | 8/1996 | |
| JP | 08-206260 | A | | 8/1996 | |
| JP | 08-229169 | A | | 9/1996 | |
| JP | 9-056855 | A | | 3/1997 | |
| JP | 09-070457 | A | | 3/1997 | |
| JP | 09-099120 | A | | 4/1997 | |
| JP | 09-253250 | A | | 9/1997 | |
| JP | 09253250 | A | * | 9/1997 | A63B 53/04 |
| JP | 10-000250 | A | | 1/1998 | |
| JP | 10-000251 | A | | 1/1998 | |
| JP | 2825022 | B2 | | 9/1998 | |
| JP | 2926702 | B2 | | 5/1999 | |
| JP | 2002-000779 | A | | 1/2002 | |
| JP | 2004-000674 | A | | 1/2004 | |
| JP | 2005-312619 | A | | 11/2005 | |
| JP | 2005-319019 | A | | 11/2005 | |
| JP | 2007-202633 | A | | 8/2007 | |
| JP | 2007202633 | A | * | 8/2007 | |
| JP | 2007-301016 | A | | 11/2007 | |
| JP | 2007-301017 | A | | 11/2007 | |
| JP | 2007-319344 | A | | 12/2007 | |
| JP | 2008-005994 | A | | 1/2008 | |
| JP | 2008005994 | A | * | 1/2008 | |
| JP | 2008-023178 | A | | 2/2008 | |
| JP | 2008-132168 | A | | 6/2008 | |
| JP | 2008-132169 | A | | 6/2008 | |
| JP | 2008-136619 | A | | 6/2008 | |
| JP | 2008-136833 | A | | 6/2008 | |
| JP | 2008-272271 | A | | 11/2008 | |
| JP | 2009-261886 | A | | 11/2009 | |
| JP | 2010-35846 | A | | 2/2010 | |

* cited by examiner

GOLF CLUB HEAD

BACKGROUND OF THE INVENTION

1. Field of the Invention

The present invention relates to a golf club head.

2. Description of the Related Art

In general, a plurality of parallel linear grooves are formed in the face surface of a golf club head to extend in the toe-to-heel direction. These grooves are called, for example, scorelines, marking lines, or face lines (they will be referred to as scorelines in this specification). These scorelines have an effect of increasing the back spin amount on a struck golf ball, or suppressing a significant decrease in back spin amount on a struck golf ball upon a shot in rainy weather or that from the rough.

A rule concerning the scorelines of an athletic golf club head stipulates that the edge of each scoreline must fall within a virtual circle which has a radius of 0.011 inches and is concentric with a virtual circle which has a radius of 0.010 inches and is inscribed in both the side wall of this scoreline and the face surface (to be referred to as the "two-circle rule" hereinafter). To comply with the two-circle rule, it is effective to, for example, chamfer the edges of the scorelines.

Unfortunately, when the edges of the scorelines are chamfered, the back spin amount on a struck golf ball decreases. Under the circumstance, techniques of forming grooves finer than the scorelines in the face surface have been proposed (for example, Japanese Patent Laid-Open No. 2007-202633). These fine grooves are effective in preventing a decrease in back spin amount on a struck golf ball.

However, when grooves finer than the scorelines are formed in the face surface, a variation in back spin amount may occur depending on the position of a striking point. An advanced golfer who has a keen sense may feel uncomfortable with this variation albeit small.

SUMMARY OF THE INVENTION

It is an object of the present invention to suppress a decrease in back spin amount on a struck golf ball and the occurrence of a variation in back spin amount depending on the position of a striking point when rounded portions are formed on the edges of scorelines.

According to the present invention, there is provided a golf club head comprising a plurality of scorelines are formed in a face surface thereof at an equal pitch, wherein rounded portions are formed on edges of the scorelines, each region between adjacent scorelines includes a fine groove formation region in which N ($N \geq 2$) fine grooves are formed to extend parallel to the scorelines and to align themselves in a direction perpendicular to the scorelines at an interval d ($d \geq 0$), and letting S be a distance between endpoints of the rounded portions of the adjacent scorelines, Wt be a sum total of widths of all the fine grooves, A1 be a distance from the endpoint of the rounded portion of one scoreline of the adjacent scorelines to the fine groove formation region, A2 be a distance from the endpoint of the rounded portion of the other scoreline of the adjacent scorelines to the fine groove formation region, and Wmax be a maximum width of the widths of the fine grooves, $0 \leq A1+A2 < Wmax+d$, $|A1-A2| < (Wmax+d)/4$, and $Wt+d \times (N-1)+A1+A2=S$.

Further features of the present invention will become apparent from the following description of exemplary embodiments with reference to the attached drawings.

DESCRIPTION OF THE EMBODIMENTS

First Embodiment

Figure 1:
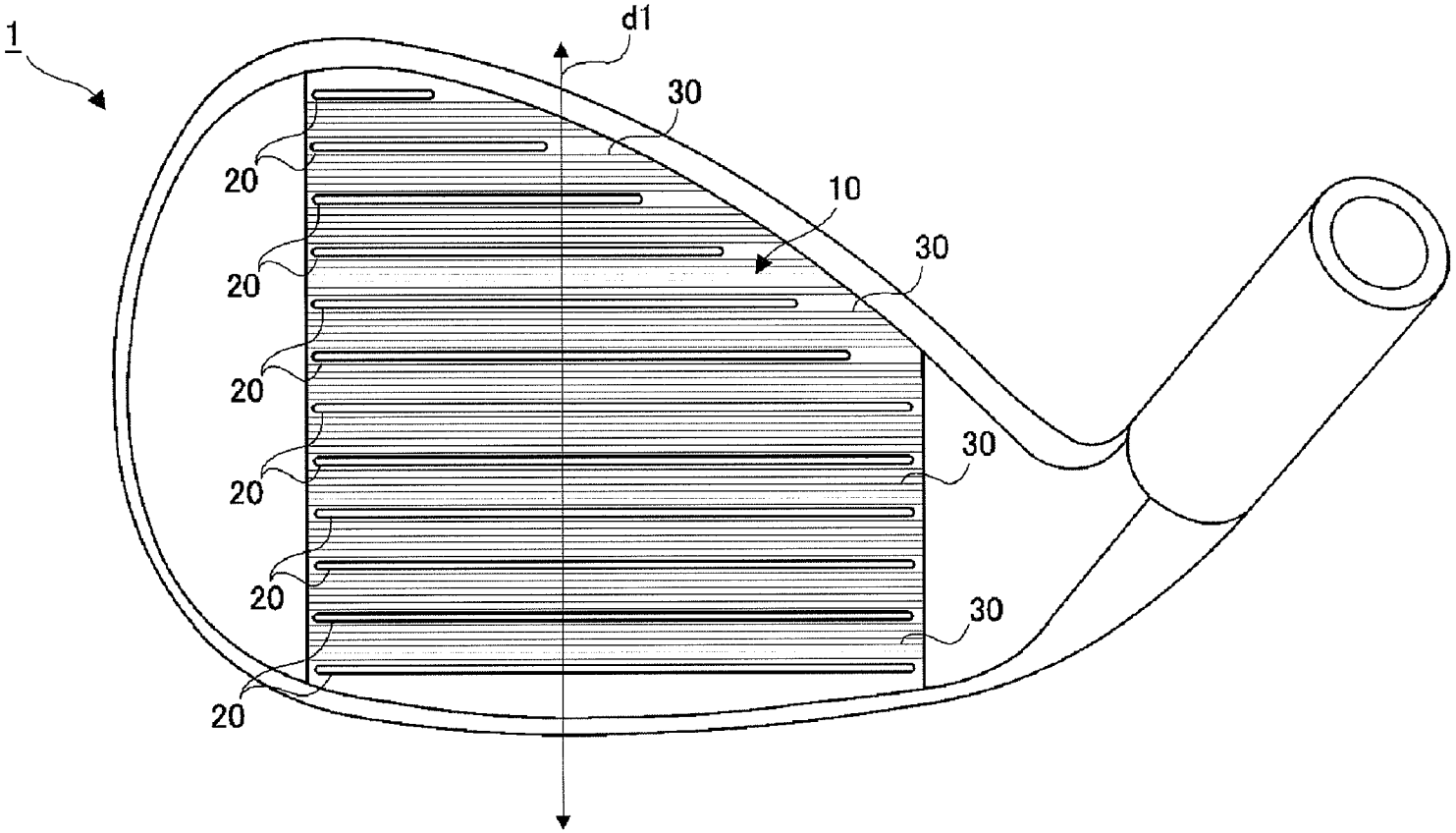
FIG. 1 is an external view of a golf club head 1 according to an embodiment of the present invention.

FIG. 1 is an external view of a golf club head 1 according to an embodiment of the present invention. FIG. 1 illustrates an example in which the present invention is applied to an iron type golf club head. The present invention is suitable for an iron type golf club head and, more particularly, for middle iron, short iron, and wedge type golf club heads. More specifically, the present invention is suitable for a golf club head with a loft angle of 30° (inclusive) to 70° (inclusive) and a head weight of 240 g (inclusive) to 320 g (inclusive). However, the present invention is also applicable to wood type and utility (hybrid) type golf club heads.

The golf club head 1 has a plurality of scorelines 20 formed in its face surface (striking surface) 10. The scorelines 20 are parallel linear grooves extending in the toe-to-heel direction. Also, the face surface 10 has a plurality of fine grooves 30 formed in it. The plurality of fine grooves 30 are linear grooves formed to extend parallel to the scorelines 20 in the toe-to-heel direction and to align themselves in a direction d1 perpendicular to the longitudinal direction of the scorelines 20.

Figure 2:
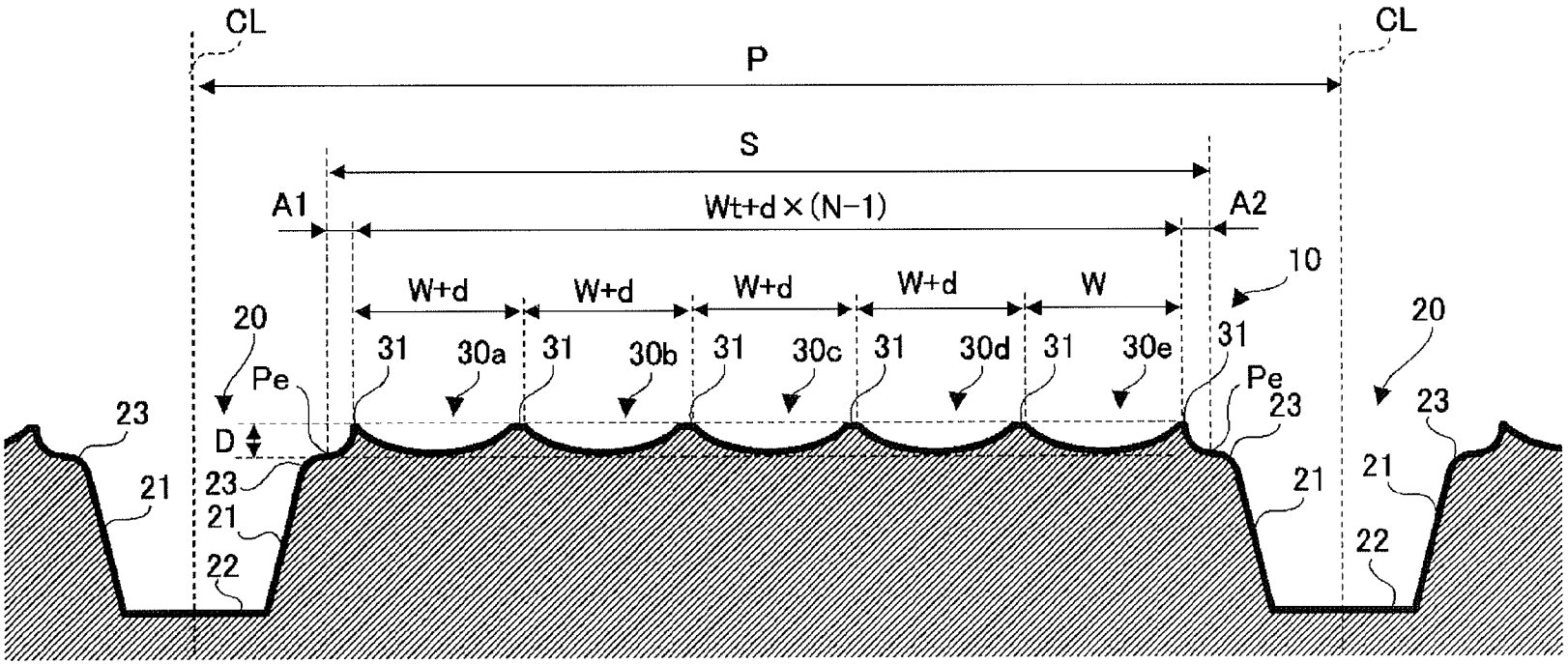
FIG. 2 is a sectional view of scorelines 20 and fine grooves 30 taken in a direction d1 perpendicular to their longitudinal direction (the toe-to-heel direction)
Figure 3:
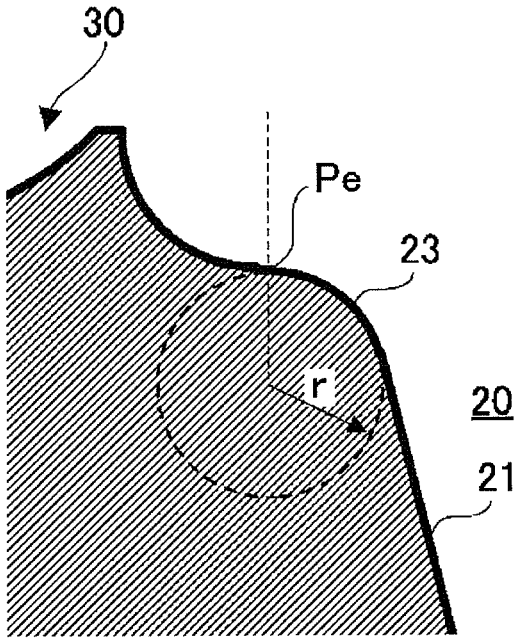
FIG. 3 is an enlarged sectional view of an edge 23 of the scoreline 20.

FIG. 2 is a sectional view of the scorelines 20 and fine grooves 30 taken in the direction d1 perpendicular to their longitudinal direction (the toe-to-heel direction) in the range across two adjacent scorelines 20. FIG. 3 is an enlarged sectional view of an edge 23 of the scoreline 20. The scorelines 20 will be described first.

In this embodiment, the scorelines 20 are formed at an equal pitch (pitch P), and have uniform cross-sectional shapes throughout their entire longitudinal portions except for their two ends. Also, the scorelines 20 have the same cross-sectional shape. Moreover, in this embodiment, the cross-sectional shape of the scoreline 20 is symmetrical about a virtual center line CL in the widthwise direction. The virtual center line CL is perpendicular to the face surface 10, and passes through the midpoint of a width W of the scoreline 20. Although the cross-sectional shape of the scoreline 20 is a trapezoidal shape in this embodiment, it may be another shape such as a V shape.

The scoreline 20 has a pair of side walls 21 and a bottom wall 22. The edge 23 of the scoreline 20 is the boundary portion between the side wall 21 and the face surface 10. A rounded portion with a radius r is formed on the edge 23, as shown in FIG. 3. The radius r can be set to comply with, for example, the two-circle rule.

The fine grooves 30 will be described next with reference to FIG. 2. Although a rounded portion is formed on the edge 23 of the scoreline 20, as mentioned above, a decrease in back spin amount on a struck golf ball can be prevented by forming the fine grooves 30.

The fine grooves 30 are formed in each fine groove formation region with a width Wt between adjacent scorelines 20. Protrusions 31 are formed to have the same amount of projection (the same height in the normal direction to the face surface 10) upon forming the fine grooves 30. The fine groove formation regions have the same cross-sectional shape. In other words, fine groove formation regions are repeatedly formed in the same shape between the scorelines 20 over almost the entire region on the face surface 10.

The width Wt is the sum total of the widths W of the fine grooves 30. In this embodiment, five fine grooves 30*a* to 30*e* are formed in one fine groove formation region, and all of them have the same cross-sectional shape, width W, and depth D. Therefore, Wt=5×W. Considering, for example, manufacturing errors, when the difference between the maximum and minimum widths of the widths W of the fine grooves 30 is less than 0.1 mm, the fine grooves 30 can be evaluated to have the same width. Similarly, when the difference between the maximum and minimum depths of the depths D of the fine grooves 30 is less than 0.1 mm, the fine grooves 30 can be evaluated to have the same depth. The same holds true when the fine grooves 30 have the same width and depth hereinafter.

The width W of the fine groove 30 is preferably, for example, 200 μm (inclusive) to 800 μm (inclusive). The smaller the depth D of the fine groove 30, the smaller the amount of increase in back spin amount, whereas the larger the depth D, the more a struck ball is likely to be scratched. Hence, the depth D is preferably 10 μm (inclusive) to 30 μm (inclusive). The higher the surface roughness of the fine groove formation region, the larger the amount of increase in back spin amount, whereas the lower the surface roughness, the more a struck ball is likely to be scratched. Hence, the surface roughness of the fine groove formation region preferably corresponds to an arithmetic average roughness (Ra) of 2.0 μm (inclusive) to 6.0 μm (inclusive).

The roughness of the face surface of an athletic golf club head has a predetermined limit defined by a maximum height (Ry) of 25 μm or less and an arithmetic average roughness of 4.57 μm or less. Hence, when the golf club head 1 is to be used as an athletic golf club head, it is designed such that the width W and depth D of the fine groove 30 also comply with the surface roughness rule. For example, the surface roughness of the fine groove formation region preferably corresponds to an arithmetic average roughness (Ra) of 2.0 μm (inclusive) to 4.57 μm (inclusive). Also, the depth D is preferably 10 μm (inclusive) to 25 μm (inclusive).

The fine groove formation region starts from a point spaced apart from an endpoint Pe of the rounded portion on the edge 23 of one scoreline 20 of adjacent scorelines 20 by a distance A1, and ends at a point spaced apart from an endpoint Pe of the rounded portion on the edge 23 of the other scoreline 20 of the adjacent scorelines 20 by a distance A2. The endpoint Pe is the point beyond which the contour shape of the edge 23 no longer overlaps the circle with the radius r, as shown in FIG. 3.

Referring back to FIG. 2, the fine grooves 30 are formed at the same interval d (d≥0). Letting Wmax be the maximum width of the widths of the fine grooves 30, $$0 \leq A1+A2 < W\max+d \quad (1)$$

$$|A1-A2| < (W\max+d)/4 \quad (2)$$

Note that in this embodiment, all the fine grooves 30 have the same width, as mentioned above. Relation (2) means that the distances A1 and A2 are nearly the same. However, (distance A1)=(distance A2) may be set. In this case, considering, for example, manufacturing errors, when the difference between the distances A1 and A2 is 0.1 mm, the fine groove 30 can be evaluated to satisfy (distance A1)=(distance A2).

Letting S be the distance between adjacent endpoints Pe, the distances S, A1, and A2, the width Wt, and the interval d satisfy a relation:

$$Wt+d\times(N-1)+A1+A2=S \quad (3)$$

where N is the number of fine grooves 30 and is five in this embodiment.

Relations (1) to (3) mean that a fine groove formation region is formed in almost the middle between adjacent scorelines 20 to allow the plurality of fine grooves 30 to perfectly fall within it. In this embodiment, the five fine grooves 30*a* to 30*e* perfectly fall within the fine groove formation region. The distances A1 and A2 are adjusting margins used to allow the plurality of fine grooves 30 to perfectly fall within the fine groove formation region, and are preferably zero or infinitely close to zero.

In this embodiment, fine grooves 30 are formed in the same pattern, as mentioned above, in each region between adjacent scorelines 20 over almost the entire region on the face surface 10. Thus, when a ball is struck under the same conditions, the contact state between the ball and the fine grooves 30 always remains nearly the same, thereby making it possible to suppress the occurrence of a variation in back spin amount depending on the position of a striking point. Still better, in this embodiment, all the fine grooves 30 have the same width W and depth D, thereby making it possible to further suppress the occurrence of a variation in back spin amount depending on the position of a striking point.

Figure 4:
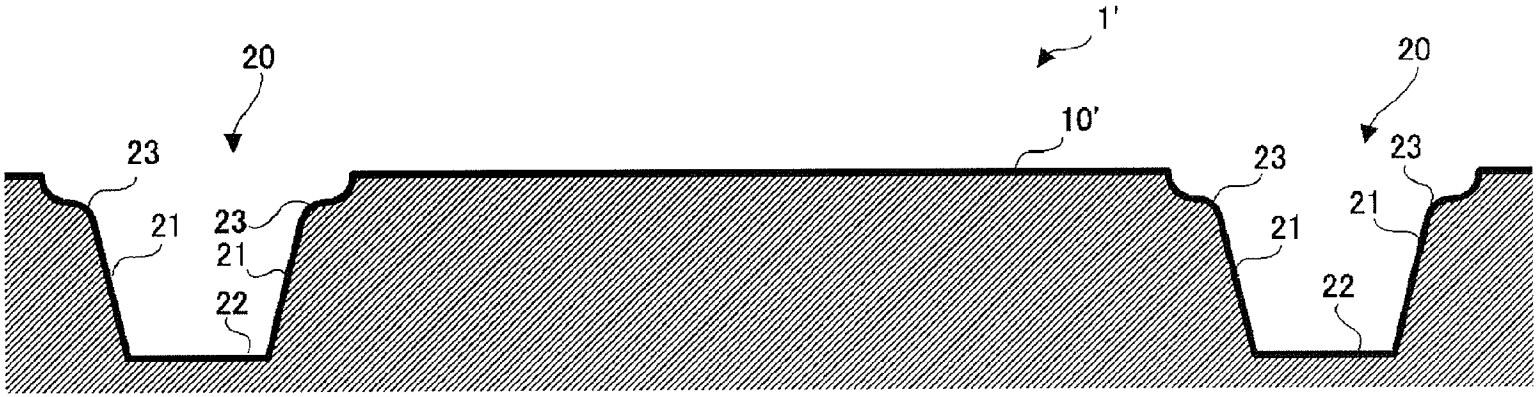
FIG. 4 is a sectional view showing a primary shaped product 1' before fine grooves 30 are formed.
Figure 5:
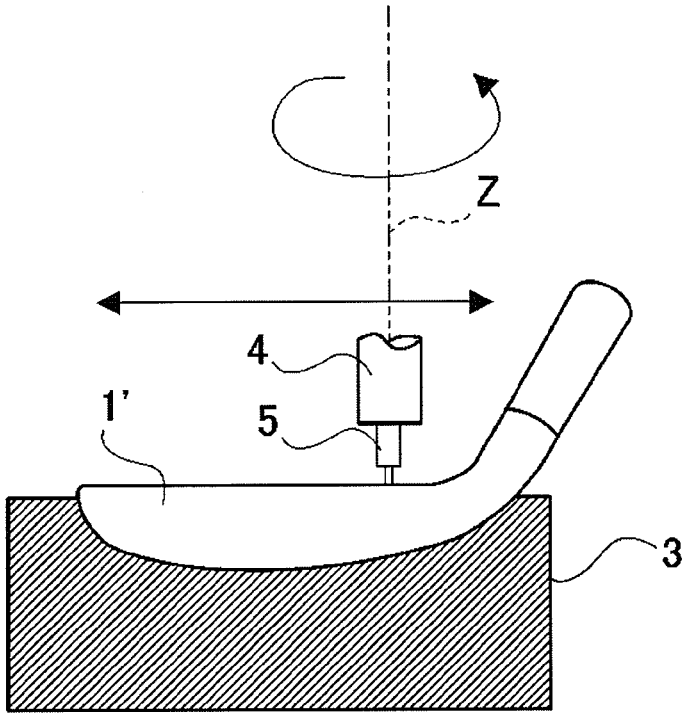
FIG. 5 is a view for explaining a method of forming fine grooves 30 by an NC milling machine.

A method of forming scorelines 20 and fine grooves 30 will be described next. Scorelines 20 can be formed by, for example, forging, molding, cutting, or laser processing. Fine grooves 30 can be formed by, for example, cutting or laser processing. A case in which scorelines 20 are formed by forging and fine grooves 30 are formed by milling will be described herein with reference to FIGS. 4 and 5. FIG. 4 is a sectional view showing a primary shaped product 1' before fine grooves 30 are formed, and FIG. 5 is a view for explaining a method of forming fine grooves 30 by an NC milling machine.

First, a primary shaped product 1' of a golf club head 1, in which scorelines 20 are formed by forging, is fabricated, as shown in FIG. 4. In the primary shaped product 1', no fine grooves 30 are formed in a surface 10' corresponding to the face surface 10.

Next, fine grooves 30 are formed by milling. The primary shaped product 1' in which no fine grooves 30 are formed is fixed to an NC milling machine via a jig 2, as shown in FIG. 5. Although the face surface 10 is shaped integrally with the golf club head 1 in this embodiment, a face member which forms the face surface 10 and the head body may be provided as separate members and bonded to each other.

The NC milling machine includes a spindle 4 which is rotationally driven about the Z-axis, and a cutting tool (end mill) 5 attached to the lower end of the spindle 4. The distal end shape of the cutting tool 5 conforms to the cross-sectional shape of the fine groove 30.

After the plane coordinates of the face surface 10 are set on the NC milling machine, the spindle 4 is rotationally driven to cut the face surface 10 while relatively moving the face surface 10 (primary shaped product 1') or the cutting tool 5 in the direction to form fine grooves 30. When one fine groove 30 is formed in the face surface 10, the cutting tool 5 is separated from the face surface 10. After that, the cutting tool 5 is relatively moved in the direction in which fine grooves 30 are aligned to form the next fine groove 30, thereby sequentially forming fine grooves 30.

When the fine grooves 30 are formed in the face surface 10, it is often the case that the hardness of the face surface 10 decreases and the face surface 10 becomes more likely to wear out. To prevent this, after the formation of the fine grooves 30, a surface treatment for hardening the face surface 10 is preferably performed. Examples of such a surface treatment include carburizing, nitriding, soft nitriding, PVD (Physical Vapor Deposition), ion plating, diamond-like carbon coating, and plating. Especially a surface treatment which modifies a surface without forming another metal layer on the surface, such as carburizing or nitriding, is preferable.

Second Embodiment

Figure 6:
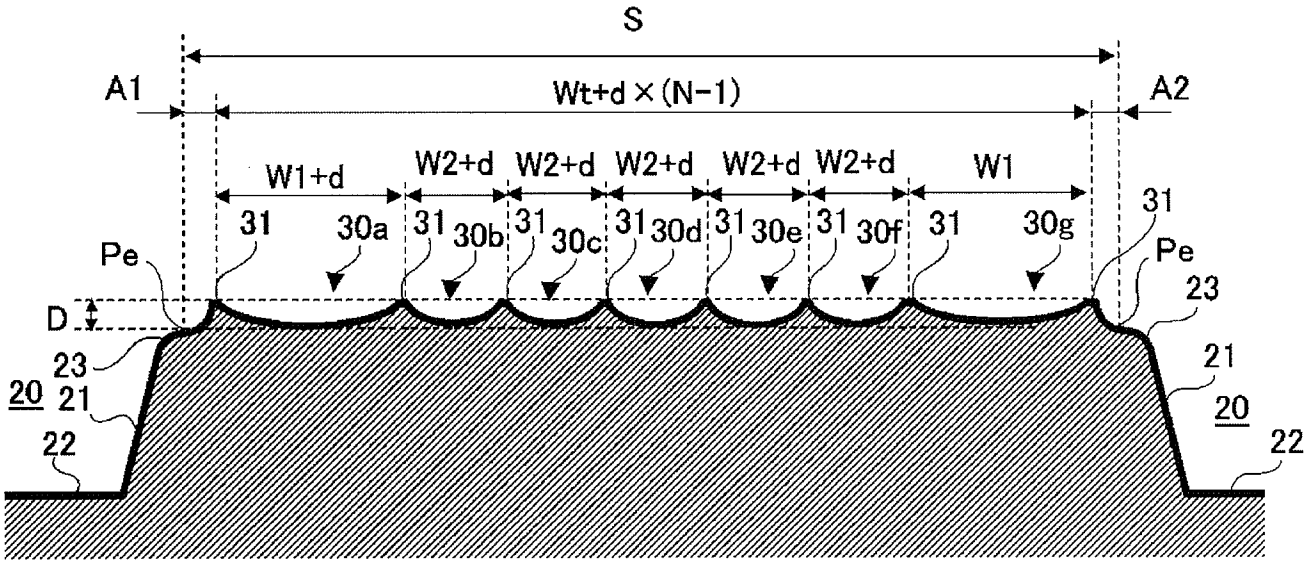
FIG. 6 is a sectional view showing another example of the fine grooves 30.

Although all the fine grooves 30 have the same width W in each fine groove formation region in the first embodiment, they may have different widths W. FIG. 6 is a sectional view showing another example of the fine grooves 30. The same reference numerals as in FIG. 2 denote the same configurations in FIG. 6.

In the example shown in FIG. 6, fine grooves 30*a* to 30*g* are formed in one fine groove formation region. Among the fine grooves 30*a* to 30*g*, the fine grooves 30*a* and 30*g* at the two ends of the fine groove formation region in the direction indicated by the arrow d1 shown in FIG. 1 have a width W1, and the remaining fine grooves 30*b* to 30*f* in this region have a width W2. The widths W1 and W2 satisfy W1>W2, the fine grooves 30*a* and 30*g* at the two ends have a widest width, and the remaining fine grooves 30*b* to 30*f* have the same width.

In this embodiment as well, fine grooves 30 are formed in the same pattern in each region between adjacent scorelines 20 over almost the entire region on a face surface 10. Thus, when a ball is struck under the same conditions, the contact state between the ball and the fine grooves 30 always remains nearly the same, thereby making it possible to suppress the occurrence of a variation in back spin amount depending on the position of a striking point.

Moreover, because the width of the fine grooves 30*a* and 30*g* at the two ends of the fine groove formation region, which are closest to the scorelines 20, is wider than the remaining fine grooves 30*b* to 30*f*, a ball strongly bites into the face surface 10 due to factors associated with the vicinity of the scorelines 20, thereby making it possible to further increase the back spin amount.

Although the fine grooves 30 at the two ends of one fine groove formation region have a width different from that of the remaining fine grooves 30 in this embodiment, all the fine grooves 30 within the fine groove formation region may have different widths. Also, for example, the fine grooves 30 closer to the two ends of the fine groove formation region may have wider widths, and those closer to its middle may have narrower widths. Nevertheless, it takes a lot of trouble to form fine grooves 30 to have different widths. Hence, the fine grooves 30 at the two ends preferably have a width different from that of the remaining fine grooves 30, as in the example shown in FIG. 6.

Third Embodiment

Figure 7:
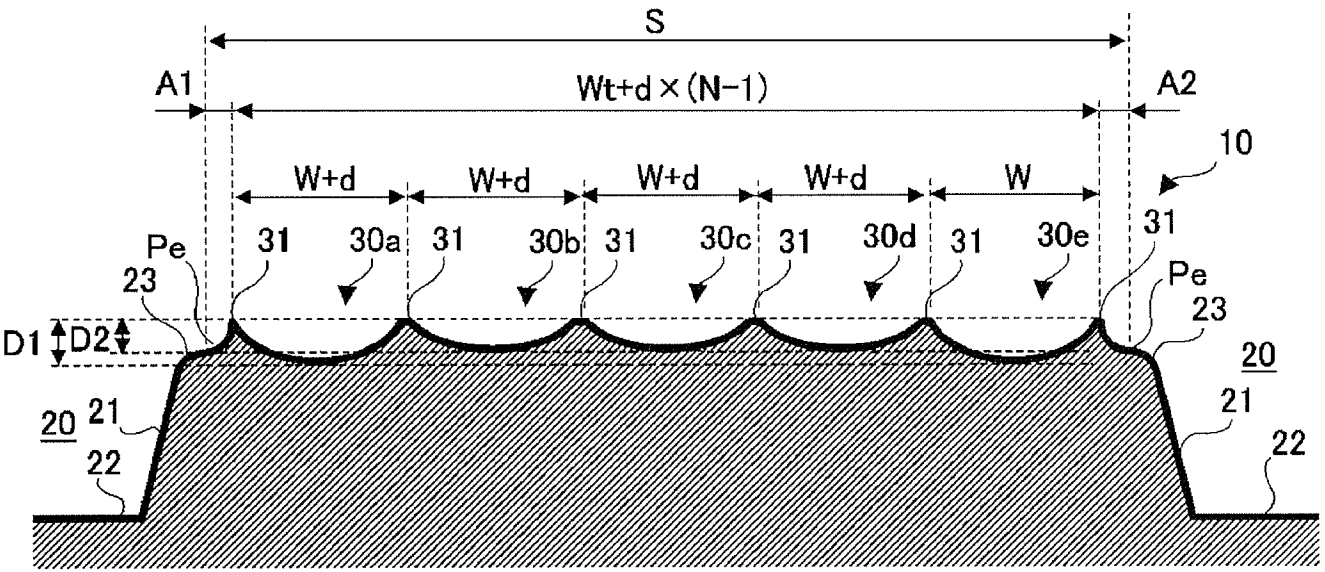
FIG. 7 is a sectional view showing still another example of the fine grooves 30.

Although all the fine grooves 30 have the same depth D in each fine groove formation region in the first embodiment, they may have different depths D. FIG. 7 is a sectional view showing another example of the fine grooves 30. The same reference numerals as in FIG. 2 denote the same configurations in FIG. 7.

In the example shown in FIG. 7, among fine grooves 30*a* to 30*e*, the fine grooves 30*a* and 30*e* at the two ends of the fine groove formation region in the direction indicated by the arrow d1 shown in FIG. 1 have a depth D1, and the remaining fine grooves 30*b* to 30*d* in this region have a depth D2. The depths D1 and D2 satisfy D1>D2, the fine grooves 30*a* and 30*e* at the two ends have a largest depth, and the remaining fine grooves 30*b* to 30*d* have the same depth.

In this embodiment as well, fine grooves 30 are formed in the same pattern in each region between adjacent scorelines 20 over almost the entire region on a face surface 10. Thus, when a ball is struck under the same conditions, the contact state between the ball and the fine grooves 30 always remains nearly the same, thereby making it possible to suppress the occurrence of a variation in back spin amount depending on the position of a striking point.

Moreover, because the depth of the fine grooves 30*a* and 30*e* at the two ends of the fine groove formation region, which are closest to the scorelines 20, is larger than the remaining fine grooves 30*b* to 30*d*, a ball strongly bites into the face surface 10 due to factors associated with the vicinity of the scorelines 20, thereby making it possible to further increase the back spin amount.

Although the fine grooves 30 at the two ends of one fine groove formation region have a depth different from that of the remaining fine grooves 30 in this embodiment, all the fine grooves 30 within the fine groove formation region may have different widths. Also, for example, the fine grooves 30 closer to the two ends of the fine groove formation region may have larger depths, and those closer to its middle may have smaller depths. Nevertheless, it takes a lot of trouble to form fine grooves 30 to have different depths. Hence, the fine grooves 30 at the two ends preferably have a depth different from that of the remaining fine grooves 30, as in the example shown in FIG. 7.

Fourth Embodiment

Figure 8:
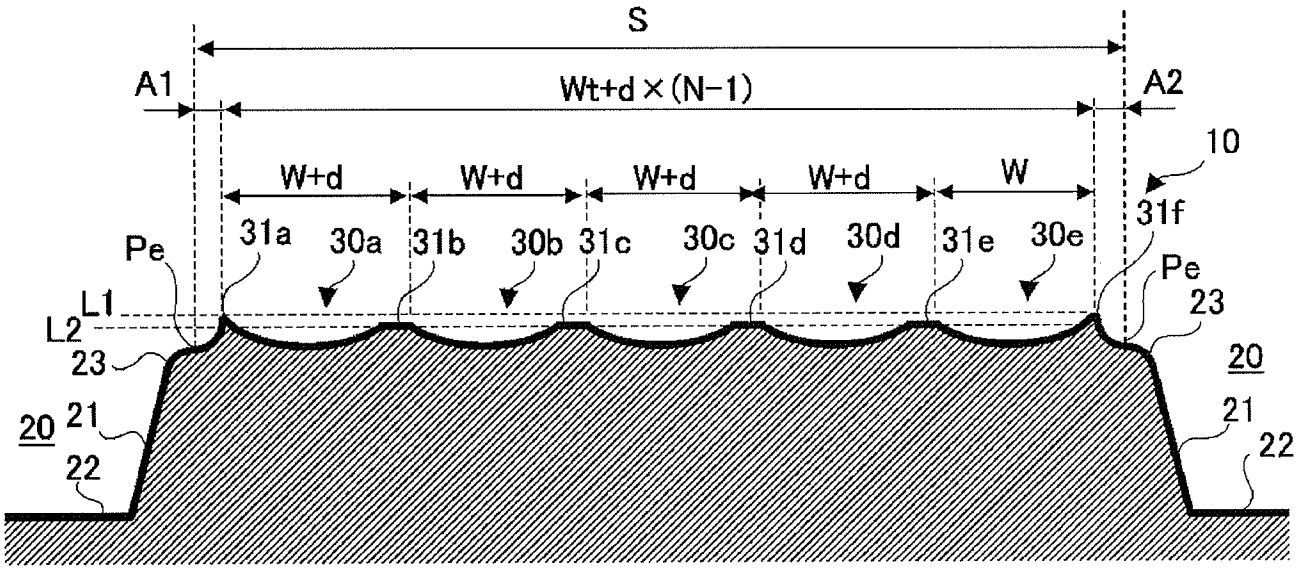
FIG. 8 is a sectional view showing still another example of the fine grooves 30.

Although all the protrusions 31 formed by the fine grooves 30 have the same amount of projection (the same height in the normal direction to the face surface 10) in the first embodiment, they may have different heights. FIG. 8 is a sectional view showing another example of the fine grooves 30. The same reference numerals as in FIG. 2 denote the same configurations in FIG. 8.

In the example shown in FIG. 8, among protrusions 31*a* to 31*f* formed by fine grooves 30*a* to 30*e*, the distal ends of the protrusions 31*a* and 31*f* at the two ends of the fine groove formation region in the direction indicated by the arrow d1 shown in FIG. 1 are at positions indicated by a line L1, and those of the remaining fine grooves 31*b* to 31*e* in this region are at positions indicated by a line L2. The line L1 is farther from a face surface 10 in the direction in which the protrusions 31*a* to 31*f* project than the line L2, and the protrusions 31*a* and 31*f* at the two ends project by a largest amount.

In this embodiment as well, fine grooves 30 are formed in the same pattern in each region between adjacent scorelines 20 over almost the entire region on the face surface 10. Thus, when a ball is struck under the same conditions, the contact state between the ball and the fine grooves 30 always remains nearly the same, thereby making it possible to suppress the occurrence of a variation in back spin amount depending on the position of a striking point.

Moreover, because the protrusions 31*a* and 31*f* at the two ends of the fine groove formation region, which are closest to the scorelines 20, project by an amount larger than the remaining protrusions 31*b* to 31*e*, a ball strongly bites into the face surface 10 due to factors associated with the vicinity of the scorelines 20, thereby making it possible to further increase the back spin amount.

Although the protrusions 31 at the two ends of one fine groove formation region have an amount of projection different from that of the remaining protrusions 31 in this embodiment, all the protrusions 31 within the fine groove formation region may have different amounts of projection. Also, for example, the protrusions 31 closer to the two ends of the fine groove formation region may have larger amounts of projection, and those closer to its middle may have smaller amounts of projection. Nevertheless, it takes a lot of trouble to form fine grooves 30 to have different amounts of projection. Hence, the protrusions 31 at the two ends preferably have an amount of projection different from that of the remaining protrusions 31, as in the example shown in FIG. 8.

Fifth Embodiment

Figure 9:
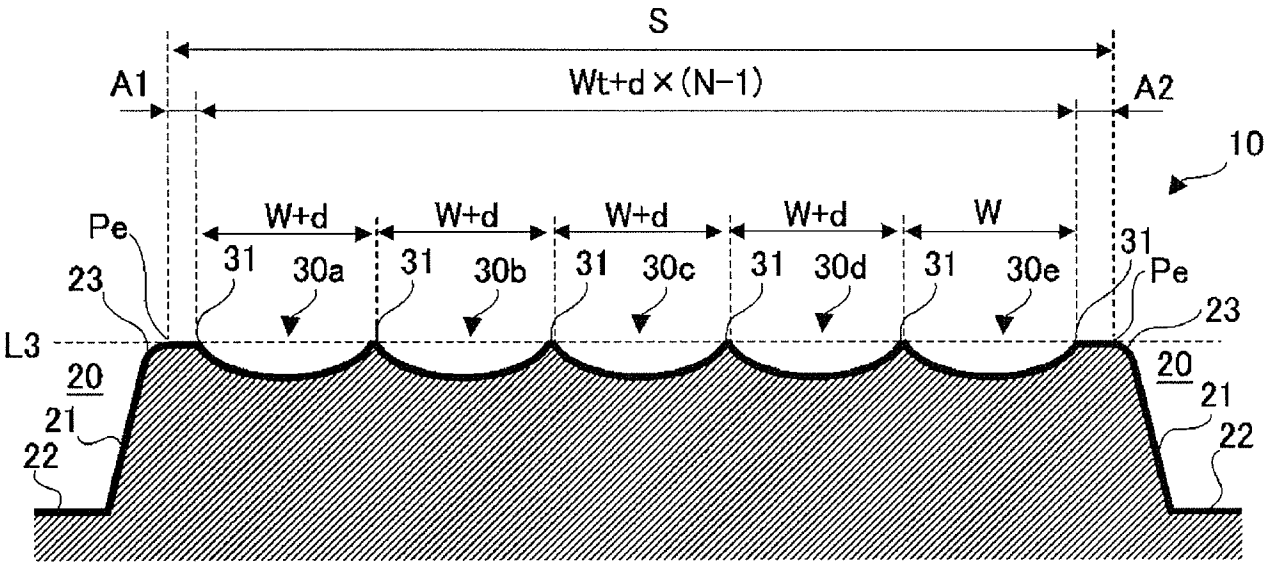
FIG. 9 is a sectional view showing still another example of the fine grooves 30.

Although the protrusions 31 project in the normal direction to the face surface 10 by an amount larger than the endpoints Pe in the first embodiment, they may project in the normal direction to the face surface 10 by an amount which is not larger than the endpoints Pe. FIG. 9 is a sectional view showing another example of the fine grooves 30. The same reference numerals as in FIG. 2 denote the same configurations in FIG. 9.

Figure 10:
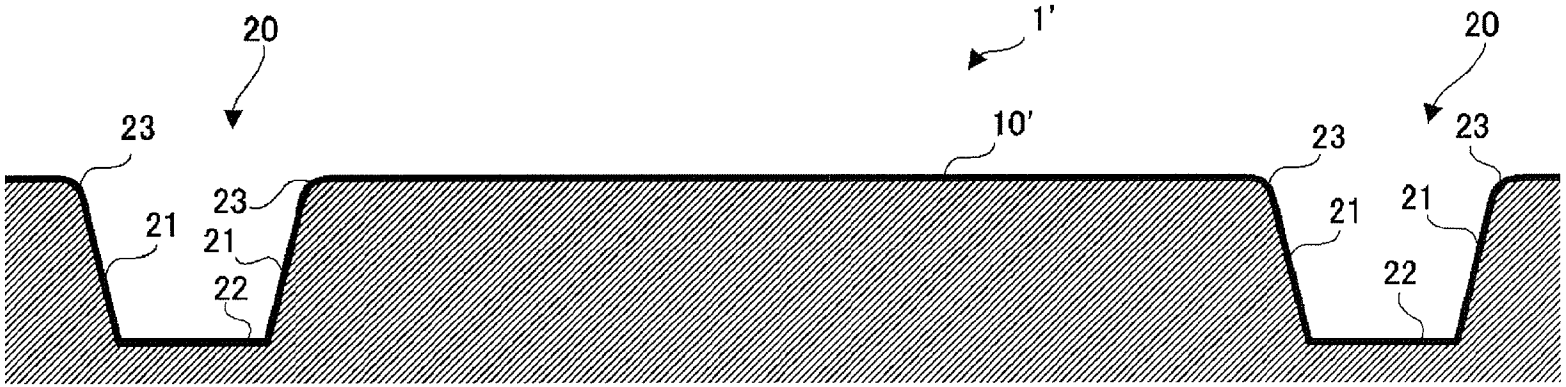
FIG. 10 is a sectional view showing another example of the primary shaped product 1' before fine grooves 30 are formed.

In the example shown in FIG. 9, each protrusion 31 projects in the normal direction to a face surface 10 by an amount which is not larger than endpoints Pe. In this embodiment, a primary shaped product 1' before fine grooves 30 are formed is formed, as illustrated in FIG. 10. As can be seen from a comparison with the example shown in FIG. 4, portions which form the fine grooves 30 are not ridged in the example shown in FIG. 10. By forming the fine grooves 30 in the primary shaped product 1' shown in FIG. 10, the protrusions 31 can project in the normal direction to the face surface 10 by an amount which is not larger than the endpoints Pe.

Sixth Embodiment

Although the fine grooves 30 have an arcuated cross-sectional shape in the first embodiment, they may have another cross-sectional shape. FIGS. 11A to 11D are sectional views showing examples of the cross-sectional shapes of fine grooves 30.

Figure 11A:
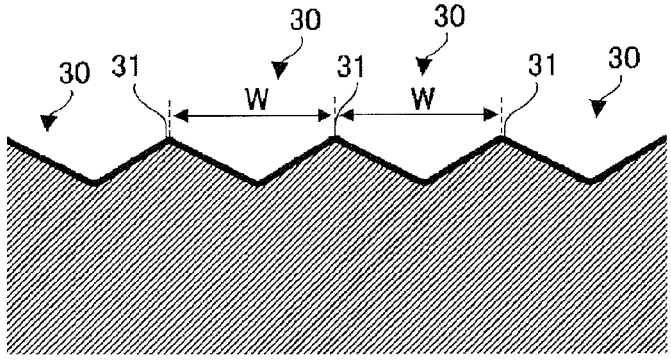
FIGS. 11A to 11D are sectional views showing examples of the cross-sectional shapes of fine grooves 30.
Figure 11B:
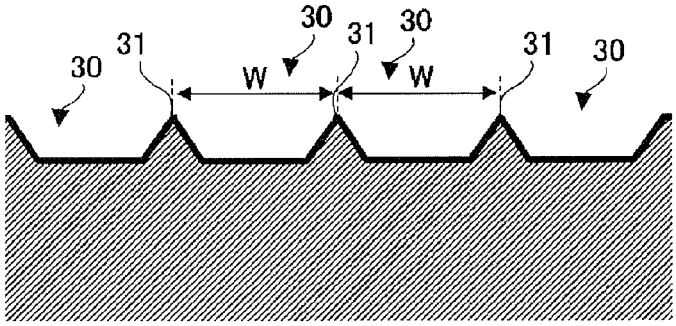
Figure 11C:
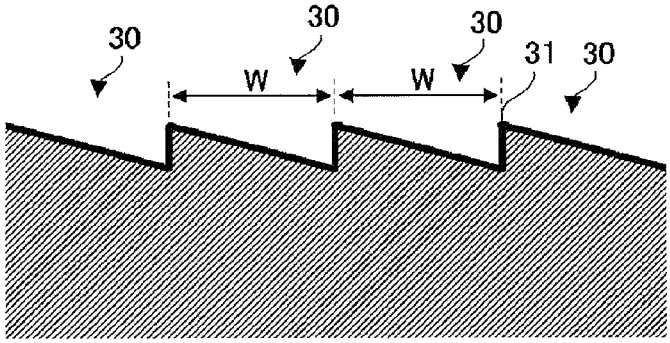
Figure 11D:
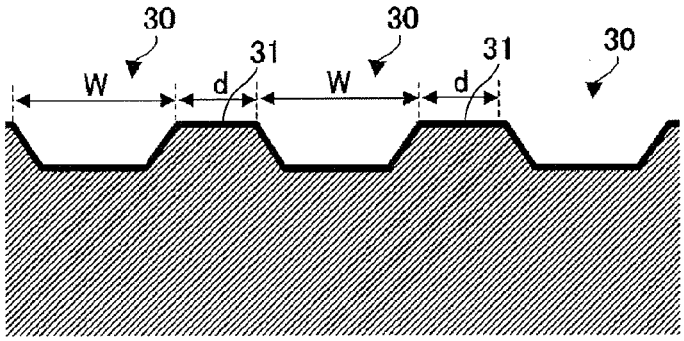

FIG. 11A illustrates an example in which the fine grooves 30 have a triangular (isosceles triangular) cross-sectional shape, FIG. 11B illustrates an example in which they have a trapezoidal cross-sectional shape, and FIG. 11C illustrates an example in which they have a triangular (right-angled triangular) cross-sectional shape. In these examples, the fine grooves 30 have zero interval (d=0) between them. When the interval d is zero, the distal ends of protrusions 31 become sharper, thus producing a greater effect of increasing the back spin amount. FIG. 11D illustrates an example in which the fine grooves 30 have a trapezoidal cross-sectional shape, and have the interval d between them.

Other Embodiments

Although a plurality of embodiments of the present invention have been described above, they can be combined with each other, as a matter of course.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-105954, filed Apr. 30, 2010, which is hereby incorporated by reference herein in its entirety.

What is claimed is:

1. A golf club head comprising a plurality of scorelines are formed in a face surface thereof at an equal pitch, wherein rounded portions are formed on edges of the scorelines, each region between adjacent scorelines includes a fine groove formation region in which N (N≥2) fine grooves are formed to extend parallel to the scorelines and to align themselves in a direction perpendicular to the scorelines at an interval d (d≥0), and letting S be a distance between endpoints of the rounded portions of the adjacent scorelines, Wt be a sum total of widths of all the fine grooves, A1 be a distance from the endpoint of the rounded portion of one scoreline of the adjacent scorelines to the fine groove formation region, A2 be a distance from the endpoint of the rounded portion of the other scoreline of the adjacent scorelines to the fine groove formation region, and Wmax be a maximum width of the widths of the fine grooves, $$0 \leq A1+A2 < W\max+d,$$

$$A1=A2, \text{ and}$$

$$Wt+d\times(N-1)+A1+A2=S.$$

2. The head according to claim 1, wherein all the fine grooves have an identical width.

3. The head according to claim 1, wherein all the fine grooves have an identical depth.

4. The head according to claim 1, wherein in the fine groove formation region, the fine grooves at two ends thereof in the direction perpendicular to the scorelines have a widest width.

5. The head according to claim 1, wherein in the fine groove formation region, the fine grooves at two ends thereof in the direction perpendicular to the scorelines have a largest depth.

6. The head according to claim 1, wherein in the fine groove formation region, the fine grooves other than the fine grooves at two ends thereof in the direction perpendicular to the scorelines have an identical width.

7. The head according to claim 1, wherein in the fine groove formation region, the fine grooves other than the fine grooves at two ends thereof in the direction perpendicular to the scorelines have an identical depth.

8. The head according to claim 1, wherein in the fine groove formation region, protrusions which are formed by the fine grooves and positioned at two ends thereof in the direction perpendicular to the scorelines, among protrusions formed by the fine grooves, project by a largest amount.

9. The head according to claim 1, wherein the fine groove is formed by one of cutting and laser processing.

10. The head according to claim 1, wherein a surface roughness of the fine groove formation region corresponds to an arithmetic average roughness (Ra) of 2.0 μm (inclusive) to 6.0 μm (inclusive).

11. The head according to claim 1, wherein a depth of the fine groove is 10 μm (inclusive) to 30 μm (inclusive).

12. The head according to claim 1, wherein $$A1=A2=0.$$

13. The head according to claim 1, wherein each fine groove has an arcuated cross-sectional shape.

14. The head according to claim 1, wherein $$A1=A2>0,$$

a region within the distance A1 from the endpoint of the rounded portion of one scoreline of the adjacent scorelines to the fine groove formation region has a flat surface, and a region within the distance A2 from the endpoint of the rounded portion of the other scoreline of the adjacent scorelines to the fine groove formation region has a flat surface.

* * * * *